US010316475B2

(12) United States Patent
Busch

(10) Patent No.: US 10,316,475 B2
(45) Date of Patent: Jun. 11, 2019

(54) PAVING MACHINE WITH MULTIPLE ZONE AUGER CONTROL

(71) Applicant: Caterpillar Paving Products Inc., Brooklyn Park, MN (US)

(72) Inventor: Matthew Busch, Becker, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 27 days.

(21) Appl. No.: 15/809,417

(22) Filed: Nov. 10, 2017

(65) Prior Publication Data

US 2019/0145062 A1 May 16, 2019

(51) Int. Cl.
*E01C 19/42* (2006.01)
*E01C 19/48* (2006.01)

(52) U.S. Cl.
CPC ..... *E01C 19/42* (2013.01); *E01C 19/4866* (2013.01)

(58) Field of Classification Search
CPC ..... E01C 19/42; E01C 19/48; E01C 19/43; E01C 2301/14; E01C 2301/16
See application file for complete search history.

(56) References Cited

U.S. PATENT DOCUMENTS 2,519,075 A * 8/1950 Schmidt ..... E02F 3/083 180/53.1
2,999,347 A * 9/1961 Horne ..... A01D 41/02 55/288
3,015,258 A * 1/1962 Apel ..... E01C 19/42 198/660
3,267,824 A * 8/1966 Hudis ..... E01C 19/4866 404/100
3,377,933 A * 4/1968 Dale ..... E01C 19/405 404/106
3,992,124 A * 11/1976 Schrader ..... E01C 19/4833 404/118
4,572,356 A * 2/1986 Janick ..... B65G 33/32 198/573
5,857,804 A * 1/1999 Musil ..... E01C 19/48 404/104
5,860,604 A 1/1999 Kooiker
(Continued)

FOREIGN PATENT DOCUMENTS

CN 1070707 A 4/1993
GB 1009498 A 11/1965

OTHER PUBLICATIONS

Florida Sprayers Inc., TeeJet Tank and Container Rinsing Nozzles, downloaded from the Internet at http://flsprayers.com/teejet/teejet-nozzles/teejet-tank-and-container-rinsing-nozzles/ on Oct. 18, 2017, 5 pp.

*Primary Examiner* — Abigail A Risic
(74) *Attorney, Agent, or Firm* — Leydig, Voit & Mayer, Ltd.

(57) ABSTRACT

A paving machine includes an auger drive system secured with a primary auger shaft, and a primary auger sleeve disposed for selective rotation with the primary auger shaft with engagement of a selectively-actuable primary auger clutch. The paving machine further includes at least a first auger extension that is selectively-engagable with the primary auger shaft with engagement of a first auger extension clutch. In this way, the primary auger sleeve and the first auger extension may be separately actuated for rotation with the auger drive system.

20 Claims, 6 Drawing Sheets

(56) References Cited

U.S. PATENT DOCUMENTS

| | | | | |
|---|---|---|---|---|
| 6,533,105 | B1 * | 3/2003 | Dutschke | B65G 33/24 198/659 |
| 7,244,077 | B2 | 7/2007 | Lee et al. | |
| 9,004,811 | B2 | 4/2015 | Mings et al. | |
| 9,045,871 | B2 | 6/2015 | Graham et al. | |
| 9,074,329 | B2 | 7/2015 | Smieja et al. | |
| 9,200,415 | B2 | 12/2015 | Graham et al. | |
| 2004/0179895 | A1 * | 9/2004 | Lee | E01C 19/405 404/101 |
| 2010/0080655 | A1 * | 4/2010 | Munz | E01C 19/48 404/118 |
| 2016/0032542 | A1 | 2/2016 | Crocker | |
| 2016/0186389 | A1 | 6/2016 | Graham et al. | |
| 2017/0314215 | A1 * | 11/2017 | Graham | E01C 19/48 |

* cited by examiner

PAVING MACHINE WITH MULTIPLE ZONE AUGER CONTROL

TECHNICAL FIELD

This patent disclosure relates generally to paving machines and, more particularly, to an arrangement for controlling the operation of a paving machine auger having multiple zones.

BACKGROUND

Paving machines are used to apply, spread and compact a "mat" of material relatively evenly over a desired surface. These machines are used regularly in the construction of roads, parking lots and other areas where a smooth durable surface is required for cars, trucks and other vehicles to travel. An asphalt paving machine, for example, generally includes a hopper for receiving asphalt material from a truck and a conveyor system for transferring the asphalt rearwardly from the hopper for discharge onto a roadbed. Transversely-disposed screw augers may be used to spread the asphalt material transversely across the roadbed in front of a screed plate. The screed plate smoothes and somewhat compacts the asphalt material and ideally leaves a roadbed of uniform depth and smoothness.

In order to help achieve the desired uniform depth and smoothness as well as to accommodate different job site conditions and different desired roadbed configurations, the screed assembly can include a variety of adjustments. These adjustments can be used to vary, for example, the width and thickness of the mat as well as the degree of any crown. Such an auger arrangement is disclosed, for example, in Chinese Publication CN1070707A, which discloses a plurality of parallel augers that may be individually clutch controlled to provide a desired thickness and width of paving material. Providing a desired thickness of the mat may be more difficult during wide width paving, however, inasmuch as the material demands may be different through the length of the screed because of varying job site conditions and desired roadbed configurations. That is, some areas along the length may require more material, while other areas require less.

Some paving machines may be adapted to provide a wider span of material by the addition of screed plate and auger extensions. Presently, however, only left and right halves of auger, including the extensions, can be independently controlled. Accordingly, present arrangements may not be sufficient for distributing varied amount of paving material along the entire length of a screed and may lead to overfill in some regions of the road surface. For example, the amount of material distributed may be high in the center of the screed, low in the middle of the left side of the screed and high at the end of the screed. Turning the entire auger, i.e., both left and right halves or all the sections of the auger, may force material into the low filling portion, but may also force more paving material towards the ends of the screed. Thus, this delivery of material may cause an over fill of the paving material on the road surface on the side receiving an excess of material at the end of the screed. It would be desirable to provide an arrangement that would permit an operator to distribute paving materials in a manner consistent with a desired road surface.

SUMMARY

In one aspect, the disclosure describes a paving machine including an auger drive system, a rotatably-mounted primary auger shaft coupled to the auger drive system for selective rotation, and a primary auger section including a primary auger sleeve, the primary auger sleeve being disposed about the primary auger shaft. A primary auger clutch is actuable between a primary auger clutch engaged position and a primary auger clutch disengaged position. The primary auger section is coupled for rotation with the primary auger shaft when the primary auger clutch is disposed in the primary auger clutch engaged position. The primary auger section is not coupled for rotation with the primary auger shaft when the primary auger clutch is disposed in the primary auger clutch disengaged position. The paving machine further includes at least a first auger extension, and at least a first auger extension clutch. The first auger extension clutch is actuable between a first auger extension clutch engaged position and a first auger extension clutch disengaged position. The first auger extension is coupled for rotation with the primary auger shaft when the first auger extension clutch is disposed in the first auger extension clutch engaged position. The first auger extension is not coupled for rotation with the primary auger shaft when the first auger extension clutch is disposed in the first auger extension clutch disengaged position.

In another aspect, the disclosure describes an auger assembly adapted for coupling to an auger drive system in a paving machine. The auger drive system provides a rotational force about an axis of rotation disposed transversely to the paving machine. The auger assembly includes a rotatably-mounted primary auger shaft adapted to be coupled to the auger drive system for rotation about the axis of rotation by the auger drive system, a primary auger section including a primary auger sleeve disposed about the primary auger shaft, and a primary auger clutch. The primary auger clutch is actuable between a primary auger clutch engaged position and a primary auger clutch disengaged position. The primary auger section is coupled for rotation with the primary auger shaft when the primary auger clutch is disposed in the primary auger clutch engaged position. The primary auger section is not coupled for rotation with the primary auger shaft when the primary auger clutch is disposed in the primary auger clutch disengaged position. The auger assembly further includes at least a first auger extension selectively rotatable about the axis of rotation, and at least a first auger extension clutch. The first auger extension clutch is actuable between a first auger extension clutch engaged position and a first auger extension clutch disengaged position. The first auger extension is coupled for rotation with the primary auger shaft when the first auger extension clutch is disposed in the first auger extension clutch engaged position. The first auger extension is not coupled for rotation with the primary auger shaft when the first auger extension clutch is disposed in the first auger extension clutch disengaged position.

In yet another aspect, the disclosure describes an auger assembly adapted for coupling to an auger drive system in a paving machine, the auger drive system providing a rotational force about an axis of rotation disposed transversely to the paving machine. The auger assembly includes a rotatably-mounted primary auger shaft adapted to be coupled to the auger drive system for rotation about the axis of rotation by the auger drive system, a primary auger section including a primary auger sleeve disposed about the primary auger shaft, and a primary auger clutch. The primary auger clutch is actuable between a primary auger clutch engaged position and a primary auger clutch disengaged position. The primary auger section is coupled for rotation with the primary auger shaft when the primary auger clutch is disposed in the primary auger clutch engaged position. The primary auger section is not coupled for rotation with the primary auger shaft when the primary auger clutch is disposed in the primary auger clutch disengaged position. The auger assembly further includes at least a first auger extension selectively rotatable about the axis of rotation, and at least a first auger extension clutch. The first auger extension clutch actuable between a first auger extension clutch engaged position and a first auger extension clutch disengaged position. The first auger extension is coupled for rotation with the primary auger shaft when the first auger extension clutch is disposed in the first auger extension clutch engaged position. The first auger extension is not coupled for rotation with the primary auger shaft when the first auger extension clutch is disposed in the first auger extension clutch disengaged position. The second auger extension includes at least one of the following: the first auger extension being secured with a first auger extension shaft, wherein actuation of the first auger extension clutch between the first auger extension clutch engaged position and the first auger extension clutch disengaged position engages or disengages the first auger extension shaft from rotation with the primary auger shaft; and the first auger extension including a first auger extension sleeve, the first auger extension sleeve being disposed for selective rotation about a first auger extension shaft, the first auger extension shaft being secured for rotation with the primary auger shaft, wherein the first auger extension sleeve is coupled for rotation with the first auger extension shaft when the first auger extension clutch is disposed in the first auger extension clutch engaged position, and the first auger extension sleeve is not coupled for rotation with the first auger extension shaft when the first auger extension clutch is disposed in the first auger extension clutch disengaged position.

DETAILED DESCRIPTION

Figure 1:
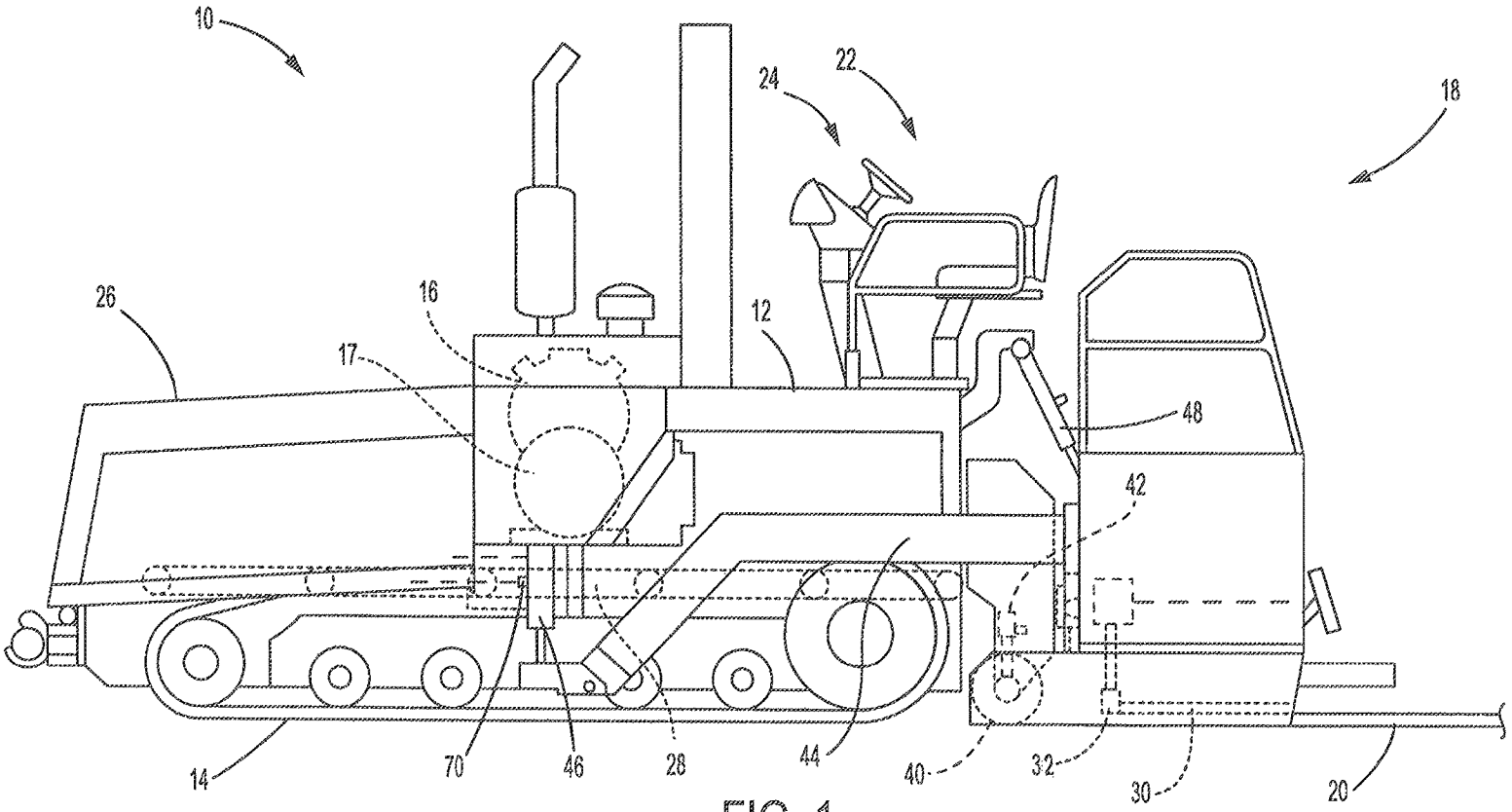
FIG. 1 is a diagrammatic side elevational view of an asphalt paving machine towing a screed assembly in accordance with the present disclosure.

This disclosure generally relates to paving machines. More specifically, certain disclosed embodiments provide a generally transversely-disposed auger assembly with rotational control over multiple zones along the length of the auger. Referring to FIG. 1, a paving machine 10 is shown that includes a frame 12 with a set of ground-engaging elements 14, such as wheels or tracks, coupled with the frame 12. The ground engaging elements 14 may be driven by an engine 16 in a conventional manner. The engine 16 may further drive an associated generator 17 that can be used to power various systems on the paving machine 10. A screed assembly 18 may be attached at the rear end of the paving machine 10 to spread and compact paving material into a layer or mat 20 of desired thickness, size and uniformity on a paving surface. The paving machine 10 may also include an operator station 22 having a seat and a console 24, which may include various controls for directing operations of the paving machine.

The paving machine 10 may further include a hopper 26 adapted for storing a paving material, and a conveyor system including one or more conveyors 28 configured to move paving material from the hopper 26 to the screed assembly 18 at the rear of the paving machine 10. The conveyors 28 may be arranged at the bottom of the hopper 26 and, if more than one is provided, may be positioned side-by-side and run parallel to one another back to the rear of the paving machine. The speed of the one or more conveyors 28 may be adjustable in order to control the rate at which paving material may be delivered to the screed assembly 18. More specifically, the height of the pile of paving material delivered to the screed assembly 18 may be increased or decreased by varying the conveyor speed relative to the speed at which the paving machine 10 is traveling. To the extent that more than one conveyor 28 is provided, the speed of each conveyor 28 may be independently variable in order to adjust the amount of paving material delivered to each side of the screed assembly 18. While an endless path conveyor is shown, one or more feed augers or other material feed components may be used instead of or in addition to the conveyor.

The screed assembly 18 may be any of a number of configurations known in the art such as a fixed width screed, screed extender or a multiple section screed that includes extensions. The screed assembly 18 is provided with a screed plate 30. As will be appreciated by those of skill in the art, the screed assembly 18 may include, for example, a main screed section with left and right screed sections (not visible in the figures). The screed assembly 18 may also include a tamper bar 32 positioned forward of a main screed section and extending transversely to the direction of travel of the paving machine 10, as shown in FIG. 1, to provide some compaction of the paving material before it is engaged by the screed plate 30. To further aid in compaction of the paving material, the screed assembly 18 may include vibratory mechanisms (not shown) that can be arranged on the upper side of the screed plate 30, including any screed extensions, and configured to drive a vibratory movement of the screed plate 30.

One or more auger assemblies 40 including one or more auger sections may be arranged near the forward end of the screed assembly 18 to receive the paving material supplied by the conveyor 28 and spread the material evenly beneath the screed assembly 18. The one or more auger assemblies 40 are generally transversely disposed relative to the paving machine 10 such that they distribute material transversely in front of the screed assembly 18. The height of the auger assembly 40 may be adjusted in order to position the auger assembly 40 at the proper height to sufficiently spread the paving material via one or more height adjustment actuators 42. For example, if the auger assembly 40 is too high, the paving material may not be sufficiently spread and the screed assembly 18 may not be able to smooth it out completely. On the other hand, if the auger assembly 40 is too low, it may disrupt the paving material such that there may not be enough material for the screed assembly 18 to smooth and compact. The height adjustment actuators 42 for the auger assembly 40 may be any suitable actuator, such as, for example, hydraulic cylinders.

As shown in FIG. 1, the screed assembly 18 may be pivotally connected behind the paving machine 10 by a pair of tow arms 44 (only one of which is visible in FIG. 1) that extend between the frame 12 of the paving machine and the screed assembly 18. The tow arms 44 are pivotally connected to the frame 12 such that the relative position and orientation of the screed assembly 18 relative to the frame, and the surface being paved, may be adjusted by pivoting the tow arms 44 in order, for example, to provide some control of the thickness of paving material deposited via the paving machine 10. To this end, tow arm actuators 46 may be provided that are arranged and configured to raise and lower the tow arms 44 and thereby raise and lower the screed assembly 18. The tow arm actuators 46 may be any suitable actuators, such as, for example, hydraulic cylinders. To provide further control over the paving process, screed lift actuators 48 may be provided that are configured such that the hydraulic pressure in the lift side of actuators, which can be referred to as the screed assist pressure, is adjustable during the paving process in order to allow the downward force applied by the screed assembly 18 to be varied.

Although only one auger assembly 40 is visible in the side elevational view of FIG. 1, the paving machine 10 may have a single auger assembly or any number of auger assemblies. While a fixed width screed typically includes a single auger assembly 40, screed extensions typically include one or more additional auger extensions to provide the distribution of material within along the respective screed extension. Those of skill in the art will appreciate that in a paving machine 10 including multiple auger assemblies or auger extensions, the augers and/or auger sections and extensions may be aligned end-to-end, and situated generally transversely to a longitudinal centerline 63 of the paving machine 10 within the screed assembly 18.

Figure 2:
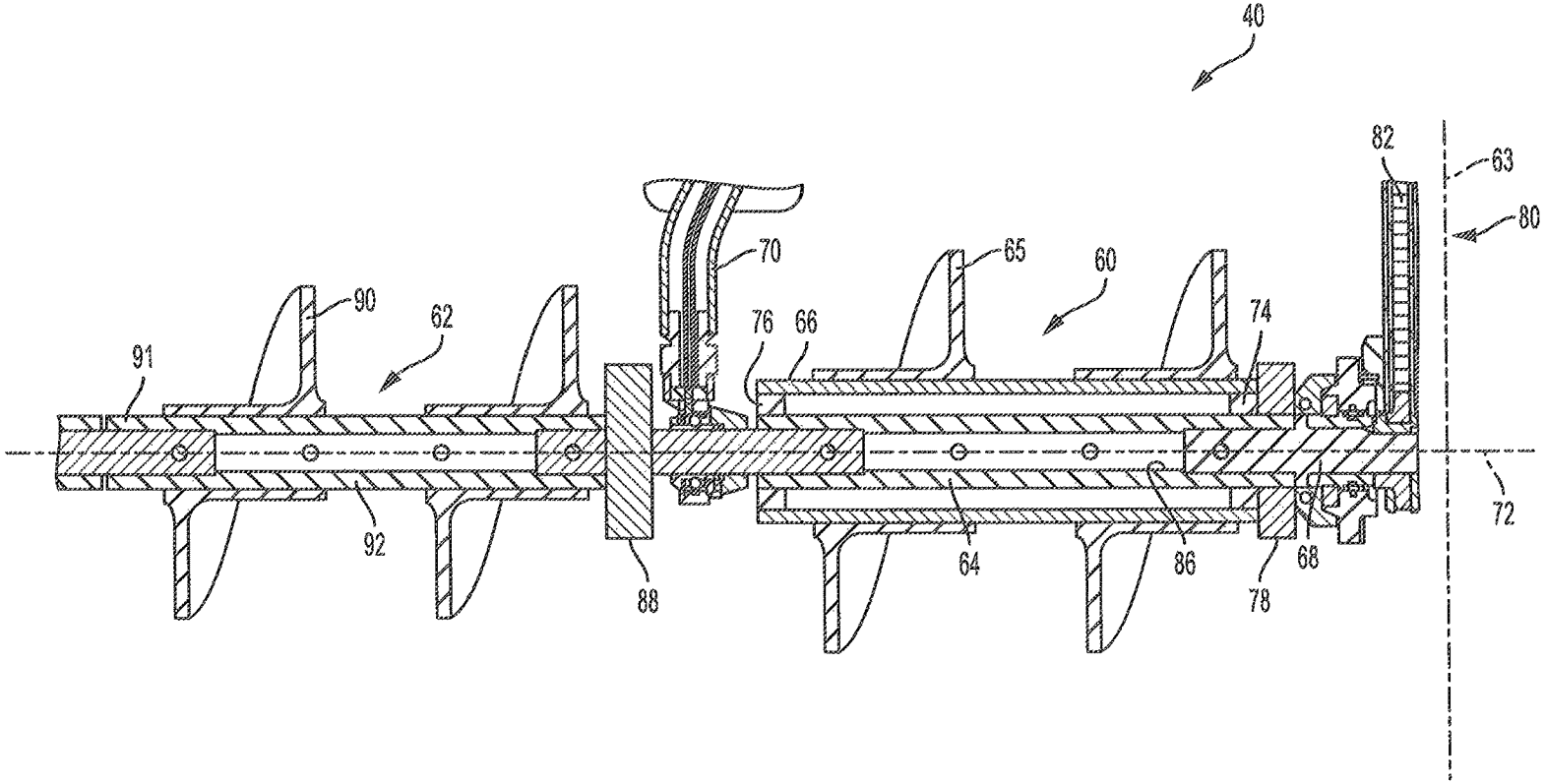
FIG. 2 is a plan view of an exemplary auger assembly of FIG. 1.

Turning to FIG. 2, there is illustrated an auger assembly 40 including a primary auger section 60, and at least a first auger extension 62. The auger assembly 40 may be disposed generally transversely to the paving machine 10, that is, transversely to the longitudinal centerline 63 extending in the direction of travel of the paving machine 10. While the longitudinal centerline 63 is illustrated along the right edge of the auger assembly 40, the longitudinal centerline 63 may be disposed alternatively. By way of example only, the longitudinal centerline 63 may be disposed through the center of the primary auger section 60. In an arrangement where the longitudinal centerline 63 is disposed along the right end of the auger assembly 40, as in FIG. 2, it will be appreciated that a second such auger assembly 40 may be provided extending transversely to the opposite side of the longitudinal centerline 63 of the paving machine 10. A second auger assembly may have a mirror-image configuration, or another configuration described below or otherwise envisioned by this disclosure.

In accordance with this disclosure, the primary auger section 60 and the first auger extension 62 may be rotated in conjunction with one another, independently rotated, or independently not rotated in order to control the output of paving material provided transversely before the screed assembly 18. For example, one or the other of the primary auger section 60 and the first auger extension 62 may be driven separately or not driven, or the primary auger section 60 and the first auger extension 62 may be driven at the same time to compensate for desired imbalances in the delivery of paving material to the screed assembly 18 or create desired imbalances in the output of the paving machine 10. Moreover, while this disclosure refers to one or more auger extensions, such auger extensions may be provided as supplements to an auger assembly associate with a paving machine 10, or may be provided in conjunction with an unextended screed assembly 18. That is, a primary auger section 60 in conjunction with one or more auger extensions 62 may be part of the auger assembly 40 provided in conjunction with an unextended screed assembly 18 of a paving machine 10.

The primary auger section 60 includes a primary auger sleeve 66 that is mounted for selective rotation about a primary auger shaft 64. One or more spiral fins or blades 65 extend outward from a peripheral surface of the primary auger sleeve 66. The primary auger shaft 64 may be supported at either end by any appropriate arrangement. In the illustrated embodiment, the primary auger shaft 64 is supported at one end by a drive output shaft 68 and at the other end by a support 70. Both the primary auger shaft 64 and the primary auger sleeve 66 are disposed for rotation about an auger axis 72. That is, the primary auger shaft 64 and the primary auger sleeve 66 are coaxially disposed for rotation about the auger axis 72. The primary auger sleeve 66 is rotatably mounted on the primary auger shaft 64 by a plurality of bearings 74, 76. The bearings 74, 76 may be of any appropriate design that permit the rotation of the primary auger sleeve 66 relative to the primary auger shaft 64.

In order to provide for selective rotation of the primary auger sleeve 66 with or about the primary auger shaft 64, a primary auger clutch 78 is provided. While the primary auger clutch 78 is disposed at the inward edge of the of the primary auger sleeve 66, the primary auger clutch 78 may be alternatively disposed, for example, along the outward edge of the primary auger sleeve 66. Those of skill in the art will appreciate that the primary auger clutch 78 and any clutch discussed in this disclosure may be of any appropriate design and operated by any appropriate mechanism.

The primary auger clutch 78 is actuable between a primary auger clutch engaged position and a primary auger clutch disengaged position. When the primary auger clutch 78 is in the primary auger clutch engaged position, the primary auger sleeve 66 is coupled for rotation with the primary auger shaft 64 about the auger axis 72. Conversely, when the primary auger clutch 78 is in the primary auger clutch disengaged position, the primary auger sleeve 66 is decoupled from the primary auger shaft 64 such that the primary auger sleeve 66 and the primary auger shaft 64 are not coupled for rotation together. That is, the primary auger shaft 64 is free to rotate within the primary auger sleeve 66 when the primary auger clutch 78 is in the primary auger clutch disengaged position.

The primary auger shaft 64 is driven by a auger drive system 80 of the paving machine 10. The auger drive system 80 may be of any appropriate arrangement and driven by any appropriate system of the paving machine 10. In the illustrated embodiment, the auger drive system 80 include a drive chain 82, which drives the drive output shaft 68 secured with the primary auger shaft 64. It will be appreciated that the primary auger shaft 64 and the drive output shaft 68 may be formed as a unitary shaft or as a plurality of components that are secured together. In the illustrated embodiment, for example, the primary auger shaft 64 includes a central bore 86 that received a portion of the drive output shaft 68. Other arrangements are envisioned. For example, a sleeve could be secured to the periphery of both the primary auger shaft and the drive output shaft, or a pin could be secured within sleeve portions of the primary auger shaft and the drive output shaft.

In order to provide selective rotation of the first auger extension 62, at least a first auger extension clutch 88 is also provided. The first auger extension clutch 88 is selectively actuable between a first auger extension clutch engaged position and a first auger extension clutch disengaged position. When the first auger extension clutch 88 is in the first auger extension clutch engaged position, the first auger extension 62 is coupled for rotation with the primary auger shaft 64 about the auger axis 72. Conversely, when the first auger extension clutch 88 is in the first auger extension clutch disengaged position, the first auger extension 62 is decoupled from the primary auger shaft 64 such that the first auger extension 62 is not coupled for rotation with the primary auger shaft 64. That is, the first auger extension 62 is not driven by the primary auger shaft 64 when the primary auger shaft 64 is driven by the auger drive system 80 when the first auger extension clutch 88 is in the first auger extension clutch disengaged position. In this way, rotation of the primary auger sleeve 66 of the primary auger section 60 and the first auger extension 62 may be independently controlled in order to provide a desired material distribution profile.

In the embodiment illustrated in FIG. 2, the first auger extension 62 includes one or more spiral fins or blades 90 extending generally radially outward from an outer peripheral surface 91 of a first auger extension shaft 92. In this way, the first auger extension 62, including the spiral fins or blades 90 and a first auger extension shaft 92, is adapted to be coupled to the primary auger shaft 64 as a unit, the entirety of the first auger extension 62 being either engaged and rotating with the primary auger shaft 64, or disengaged from the primary auger shaft 64 such that the primary auger shaft 64 is free to rotate without rotating the first auger extension 62. When the first auger extension clutch 88 is engaged in the first auger extension clutch engaged position, the first auger extension shaft 92, and, accordingly, the spiral fins or blades 90 of the first auger extension 62, are coupled for rotation with the primary auger shaft 64. When the first auger extension clutch 88 is in the first auger extension clutch disengaged position, the first auger extension shaft 92, and accordingly, the spiral fins or blades 90 of the first auger extension 62, are not coupled for rotation with the primary auger shaft 64.

Figure 3:
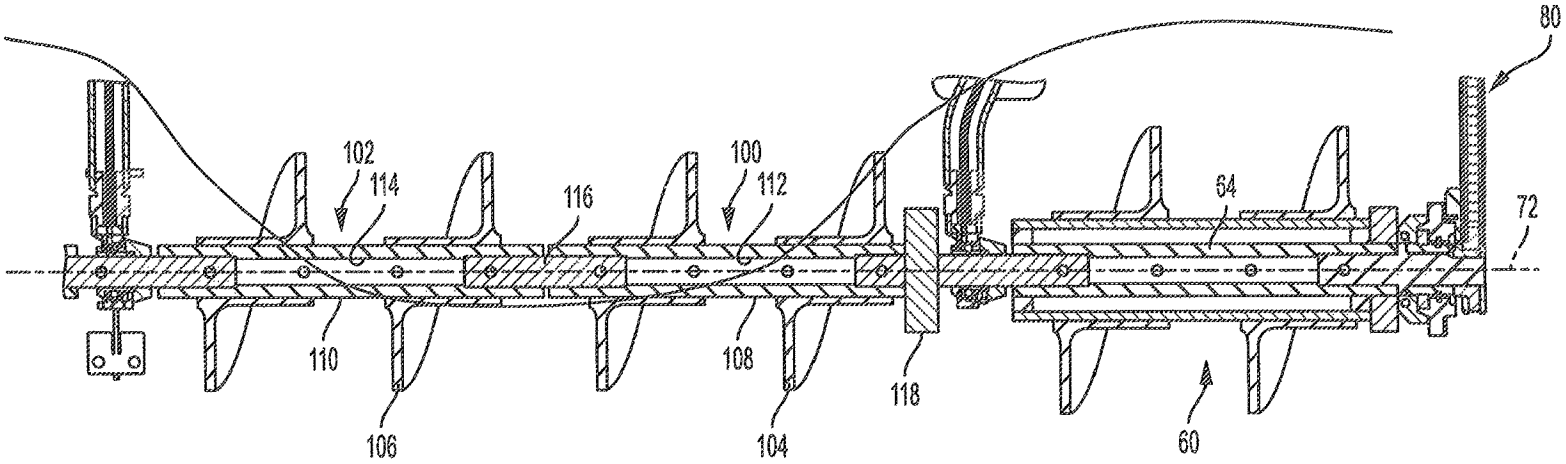
FIG. 3 is a schematic plan view of the screed assembly of FIG. 2 in an application such as illustrated in FIG. 1.

As illustrated in FIG. 3, the first auger extension may essentially include a plurality of auger sections or extensions. In FIG. 3, first and second auger extensions 100, 102 are provided. The first and second auger extensions 100, 102 may be secured together by any appropriate arrangement. In the illustrated arrangement of FIG. 3, for example, respective spiral fins or blades 104, 106 extend generally radially outward from first and second auger extension shafts 108, 110 that include respective central bores 112, 114 that receive and are secured to a coupling shaft or pin 116. As explained with regard to the coupling of the primary auger shaft 64 and the drive output shaft 68, other arrangements are envisioned.

In order to provide selective rotation of the first and second auger extensions 100, 102, a first auger extension clutch 118 is provided. The first auger extension clutch 118 is selectively actuable between a first auger extension clutch engaged position and a first auger extension clutch disengaged position. When the first auger extension clutch 118 is in the first auger extension clutch engaged position, the first auger extension shaft 108 and associated spiral fins or blades 104 are coupled for rotation with the primary auger shaft 64 about the auger axis 72. Conversely, when the first auger extension clutch 118 is in the first auger extension clutch disengaged position, the first auger extension shaft 108 and associated spiral fins or blades 104 is decoupled from the primary auger shaft 64 such that the first auger extension 100 is not coupled for rotation with the primary auger shaft 64. Further, in view of the second auger extension 102 being secured with the first auger extension 100, the second auger extension 102 is driven by the primary auger shaft 64 only when the first auger extension clutch 118 is engaged, allowing the primary auger shaft 64 driven by the auger drive system 80 to drive the first auger extension 100. It will thus be appreciated by those of skill in the art that, as with the embodiment of FIG. 2, the primary auger section 60 and the first/second auger extensions 100/102 may be independently, selectively controlled. Moreover, additional auger extensions may be provided, and similarly coupled to or decoupled from the primary auger shaft 64.

Figure 4:
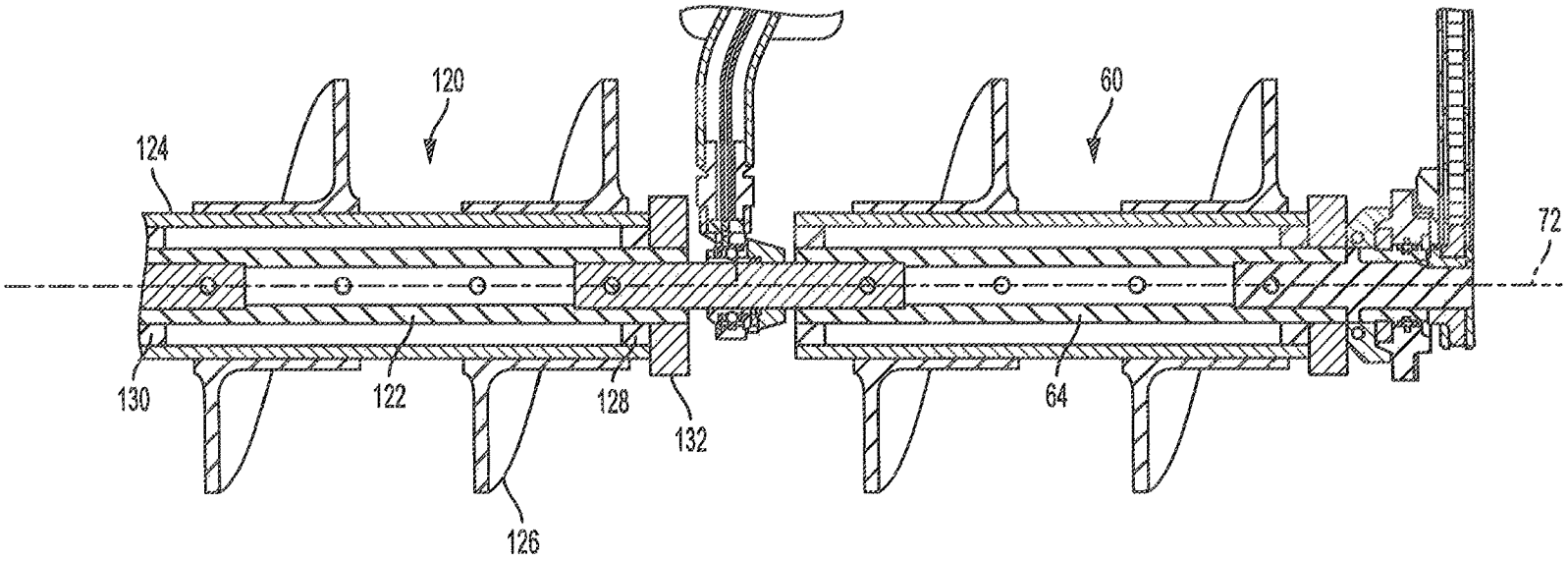
FIG. 4 is a schematic plan view of a second embodiment of an auger assembly.

Turning now to the schematic illustration of FIG. 4, it will be appreciated the first auger extension 120 may have a structure similar to that of the primary auger section 60. That is, the first auger extension 120 could include a first auger extension shaft 122 and a first auger extension sleeve 124, one or more spiral fins or blades 126 extending generally radially outward from a peripheral surface of the first auger extension sleeve 124. In the embodiment of FIG. 4, both the primary auger shaft 64 and the first auger extension shaft 122 are disposed for rotation about an auger axis 72, with the first auger extension sleeve 124 being rotatably mounted on the first auger extension shaft 122 by a plurality of bearings 128, 130. In this way, the first auger extension shaft 122 may be secured for rotation with a primary auger shaft 64.

In order to provide selective rotation of the first auger extension sleeve 124, at least a first auger extension clutch 132 is selectively actuable to engage or disengage the first auger extension sleeve 124 from the first auger extension shaft 122, which is secured for rotation with the primary auger shaft 64. When the first auger extension clutch 132 is in the first auger extension clutch engaged position, the first auger extension sleeve 124 is coupled for rotation with the first auger extension shaft 122 and the primary auger shaft 64 about the auger axis 72. Conversely, when the first auger extension clutch 132 is in the first auger extension clutch disengaged position, the first auger extension sleeve 124 is decoupled from the first auger extension shaft 122 such that the first auger extension sleeve 124 is not coupled for rotation with the first auger extension shaft 122 and the primary auger shaft 64. That is, the first auger extension sleeve 124 of the first auger extension 120 is not driven by the primary auger shaft 64 when the primary auger shaft 64 is driven by the drive system (as explained above) when the first auger extension clutch 132 is in the first auger extension clutch disengaged position. Thus, it will be appreciated by those of skill in the art that the first auger extension sleeve 124 and the primary auger sleeve 66 may both, either or neither be driven by the primary auger shaft 64.

It will further be appreciated by those of skill in the art that alternate arrangements are envisioned where a plurality of auger extensions may be selectively couplable to a primary auger section. While the embodiment of FIG. 3 includes at least a pair of auger extensions 100, 102, the operation of which is controlled by the first auger extension clutch 118, while the operation of the primary auger section 60 is controlled by the primary auger clutch 78, three or more clutches may be provided for controlling operation of the primary auger section 60 and two or more auger extensions of the types described above may be provided.

Figure 5:
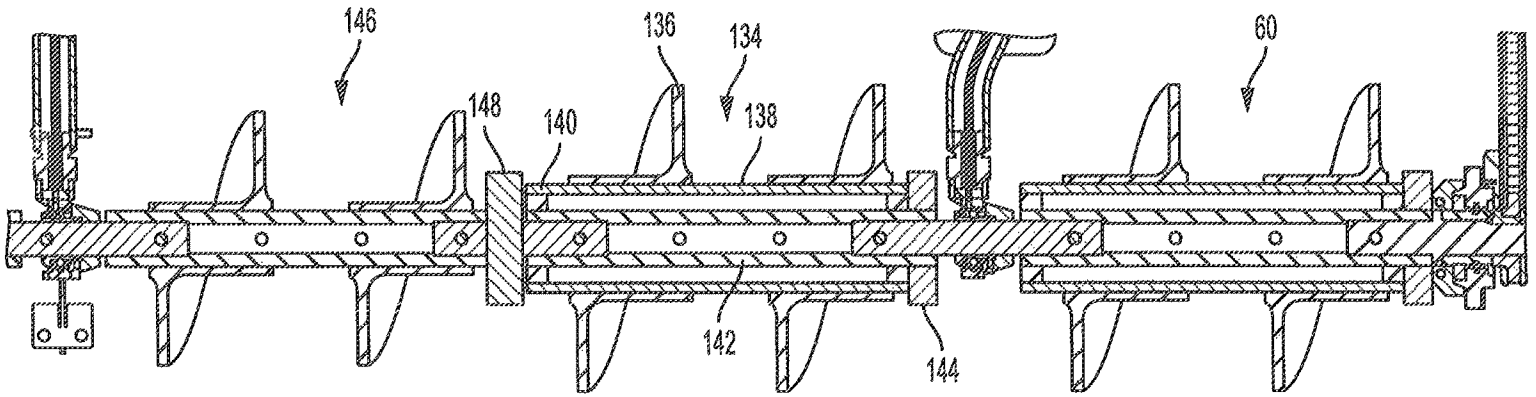
FIG. 5 is a schematic plan view of a third embodiment of an auger assembly.

By way of example only, as illustrated in FIG. 5, a first auger extension 134 may be provided including one or more spiral fins or blades 136 extending generally radially outward from a peripheral surface 138 of a first auger extension sleeve 140. The first auger extension sleeve 140 is disposed for selective rotation on a first auger extension shaft 142, the first auger extension sleeve 140 rotating with the first auger extension shaft 142 when a first auger extension clutch 144 is in a first auger extension clutch engaged position, and not rotating with first auger extension shaft 142 when the first auger extension clutch 144 is in a first auger extension clutch disengaged position. The first auger extension shaft 144 is secured for rotation with the primary auger shaft 64.

A second auger extension 146 and second auger extension clutch 148 may further be provided in a manner similar to the first auger extension and first auger extension clutch of FIG. 2. In this way, the second auger extension 146 of FIG. 5 may be engaged for rotation with the first auger extension shaft 142 when the second auger extension clutch 148 is in a second auger extension clutch engaged position, and disengaged from the first auger extension shaft 142 when the second auger extension clutch 148 is in a second auger extension clutch disengaged position.

Figure 6:
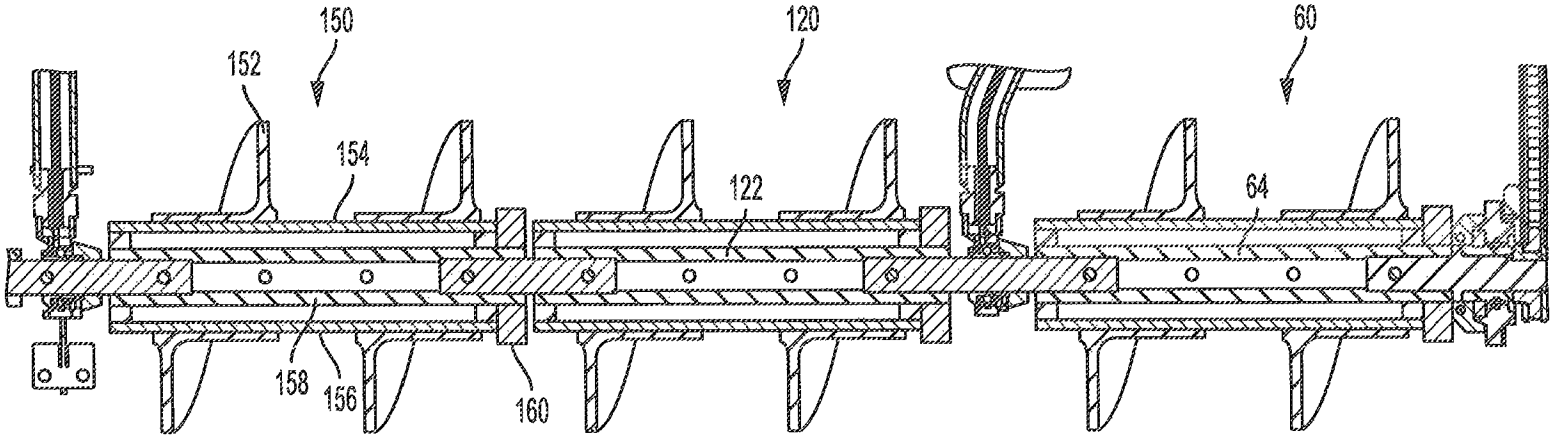
FIG. 6 is a schematic plan view of a fourth embodiment of an auger assembly.

By way of further example, as illustrated in FIG. 6, the second auger extension 150 could alternatively include one or more spiral fins or blades 152 extending generally radially outward from a peripheral surface 154 of a second auger extension sleeve 156. The second auger extension sleeve 156 of the embodiment of FIG. 6 is disposed for selective rotation on a second auger extension shaft 158, the second auger extension sleeve 156 rotating with the second auger extension shaft 158 when a second auger extension clutch 160 is in a second auger extension clutch engaged position, and not rotating with second auger extension shaft 158 when the second auger extension clutch 160 is in a second auger extension clutch disengaged position. The second auger extension shaft 158 is secured for rotation with the primary auger shaft 64 by way of its securement to the first auger extension shaft 122 of the first auger extension 120 (see also FIG. 4).

Those of skill in the art will appreciate that additional auger extensions including an auger extension sleeve with a paired rotatably mounted auger extension shaft and accompanying auger extension clutch may be provided. Similarly, additional auger extensions wherein the outer peripheral surface of the auger extension is secured with an auger extension shaft may be provided, with or without an accompanying auger extension clutch. It will be understood that any auger extensions outboard an auger extension wherein the peripheral surface of the auger extension is secured with an auger extension shaft adapted to be selectively coupled by a clutch to an inward auger extension shaft or primary auger shaft would necessarily be controlled by that clutch. For example, in FIG. 6, if an additional auger extension was provided outward from the second auger extension 150, potential rotation of that additional auger extension would necessarily be controlled by engagement of the second auger extension clutch 160.

INDUSTRIAL APPLICABILITY

The present disclosure is applicable to paving machines that include an auger assembly, and may be particularly useful in paving machines that include an auger assembly that may be extended with supplemental auger sections. An arrangement according to teachings of the present disclosure may be utilized to provide a desired distribution of paving material in some embodiments. An arrangement according to teachings of the present disclosure may be utilized to facilitate forcing paving material to a low portion of a distribution while minimizing preventing the driving of additional material to an undesired location along a screed assembly in some embodiments. An arrangement according to the present disclosure may be utilized to tailor a distribution of paving material before a screed assembly in some embodiments.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

I claim:

1. A paving machine comprising:

an auger drive system;

a rotatably-mounted primary auger shaft coupled to the auger drive system for selective rotation;

a primary auger section including a primary auger sleeve, the primary auger sleeve being disposed about the primary auger shaft;

a primary auger clutch, the primary auger clutch being actuable between a primary auger clutch engaged position and a primary auger clutch disengaged position, wherein the primary auger section is coupled for rotation with the primary auger shaft when the primary auger clutch is disposed in the primary auger clutch engaged position, and the primary auger section is not coupled for rotation with the primary auger shaft when the primary auger clutch is disposed in the primary auger clutch disengaged position;

at least a first auger extension; and at least a first auger extension clutch, the first auger extension clutch being actuable between a first auger extension clutch engaged position and a first auger extension clutch disengaged position, wherein the first auger extension is coupled for rotation with the primary auger shaft when the first auger extension clutch is disposed in the first auger extension clutch engaged position, and the first auger extension is not coupled for rotation with the primary auger shaft when the first auger extension clutch is disposed in the first auger extension clutch disengaged position.

2. The paving machine of claim 1 wherein primary auger section and the first auger extension are coaxially disposed.

3. The paving machine of claim 1 wherein the paving machine includes a frame having a longitudinal centerline, and the primary auger section and the first auger extension are disposed transverse to the paving machine along one side of the longitudinal centerline.

4. The paving machine of claim 1 further including at least a second auger extension disposed for selective rotation with the primary auger shaft.

5. The paving machine of claim 4 further including a second auger extension clutch, the second auger extension clutch being actuable between a second auger extension clutch engaged position and a second auger extension clutch disengaged position, wherein the second auger extension is coupled for rotation with the primary auger shaft when the second auger extension clutch is disposed in the second auger extension clutch engaged position, and the second auger extension is not coupled for rotation with the primary auger shaft when the second auger extension clutch is disposed in the second auger extension clutch disengaged position.

6. The paving machine of claim 1 further including a first auger extension shaft, the first auger extension being secured with the first auger extension shaft, wherein actuation of the first auger extension clutch between the first auger extension clutch engaged position and the first auger extension clutch disengaged position engages or disengages the first auger extension shaft from rotation with the primary auger shaft.

7. The paving machine of claim 6 further including at least a second auger extension, the second auger extension being secured for rotation with the first auger extension shaft.

8. The paving machine of claim 6 further including a second auger extension and a second auger extension clutch, the second auger extension clutch being actuable between a second auger extension clutch engaged position and a second auger extension clutch disengaged position, wherein the second auger extension is coupled for rotation with the first auger extension shaft when the second auger extension clutch is disposed in the second auger extension clutch engaged position, and the second auger extension is not coupled for rotation with the first auger extension shaft when the second auger extension clutch is disposed in the second auger extension clutch disengaged position.

9. The paving machine of claim 1 further including a first auger extension shaft secured for rotation with the primary auger shaft, the first auger extension including a first auger extension sleeve, the first auger extension sleeve being disposed for selective rotation about the first auger extension shaft, wherein the first auger extension sleeve is coupled for rotation with the first auger extension shaft when the first auger extension clutch is disposed in the first auger extension clutch engaged position, and the first auger extension sleeve is not coupled for rotation with the first auger extension shaft when the first auger extension clutch is disposed in the first auger extension clutch disengaged position.

10. The paving machine of claim 9 further including a second auger extension and a second auger extension clutch, the second auger extension clutch being actuable between a second auger extension clutch engaged position and a second auger extension clutch disengaged position, wherein the second auger extension is coupled for rotation with the first auger extension shaft when the second auger extension clutch is disposed in the second auger extension clutch engaged position, and the second auger extension is not coupled for rotation with the first auger extension shaft when the second auger extension clutch is disposed in the second auger extension clutch disengaged position.

11. The paving machine of claim 9 further including a second auger extension shaft secured for rotation with the first auger extension shaft, a second auger extension and a second auger extension clutch, the second auger extension including a second auger extension sleeve, the second auger extension sleeve being disposed for selective rotation about the second auger extension shaft, the second auger extension clutch being actuable between a second auger extension clutch engaged position and a second auger extension clutch disengaged position, wherein the second auger extension sleeve is coupled for rotation with the second auger extension shaft when the second auger extension clutch is disposed in the second auger extension clutch engaged position, and the second auger extension sleeve is not coupled for rotation with the second auger extension shaft when the second auger extension clutch is disposed in the second auger extension clutch disengaged position.

12. An auger assembly adapted for coupling to an auger drive system in a paving machine, the auger drive system providing a rotational force about an axis of rotation disposed transversely to the direction of motion of the paving machine, the auger assembly comprising:

a rotatably-mounted primary auger shaft adapted to be coupled to the auger drive system for rotation about the axis of rotation by the auger drive system;

a primary auger section including a primary auger sleeve, the primary auger sleeve being disposed about the primary auger shaft;

a primary auger clutch, the primary auger clutch being actuable between a primary auger clutch engaged position and a primary auger clutch disengaged position, wherein the primary auger section is coupled for rotation with the primary auger shaft when the primary auger clutch is disposed in the primary auger clutch engaged position, and the primary auger section is not coupled for rotation with the primary auger shaft when the primary auger clutch is disposed in the primary auger clutch disengaged position;

at least a first auger extension selectively rotatable about the axis of rotation; and at least a first auger extension clutch, the first auger extension clutch being actuable between a first auger extension clutch engaged position and a first auger extension clutch disengaged position, wherein the first auger extension is coupled for rotation with the primary auger shaft when the first auger extension clutch is disposed in the first auger extension clutch engaged position, and the first auger extension is not coupled for rotation with the primary auger shaft when the first auger extension clutch is disposed in the first auger extension clutch disengaged position.

13. The auger assembly of claim 12 further including a second auger extension and a second auger extension clutch, the second auger extension clutch being actuable between a second auger extension clutch engaged position and a second auger extension clutch disengaged position, wherein the second auger extension is coupled for rotation with the primary auger shaft when the second auger extension clutch is disposed in the second auger extension clutch engaged position, and the second auger extension is not coupled for rotation with the primary auger shaft when the second auger extension clutch is disposed in the second auger extension clutch disengaged position.

14. The auger assembly of claim 13 wherein the second auger extension includes a second auger extension sleeve, the auger assembly further including a second auger extension shaft secured for rotation with the first auger extension shaft, the second auger extension, the second auger extension sleeve being disposed for selective rotation about the second auger extension shaft, wherein the second auger extension sleeve is coupled for rotation with the second auger extension shaft when the second auger extension clutch is disposed in the second auger extension clutch engaged position, and the second auger extension sleeve is not coupled for rotation with the second auger extension shaft when the second auger extension clutch is disposed in the second auger extension clutch disengaged position.

15. The auger assembly of claim 12 further including at least a second auger extension, the second auger extension being secured for rotation with the first auger extension.

16. The auger assembly of claim 12 further including a first auger extension shaft, the first auger extension being secured with the first auger extension shaft, wherein actuation of the first auger extension clutch between the first auger extension clutch engaged position and the first auger extension clutch disengaged position engages or disengages the first auger extension shaft from rotation with the primary auger shaft.

17. The auger assembly of claim 12 further including a first auger extension shaft secured for rotation with the primary auger shaft, the first auger extension including a first auger extension sleeve, the first auger extension sleeve being disposed for selective rotation about the first auger extension shaft, wherein the first auger extension sleeve is coupled for rotation with the first auger extension shaft when the first auger extension clutch is disposed in the first auger extension clutch engaged position, and the first auger extension sleeve is not coupled for rotation with the first auger extension shaft when the first auger extension clutch is disposed in the first auger extension clutch disengaged position.

18. An auger assembly adapted for coupling to an auger drive system in a paving machine, the auger drive system providing a rotational force about an axis of rotation disposed transversely to the direction of travel of the paving machine, the auger assembly comprising:

a rotatably-mounted primary auger shaft adapted to be coupled to the auger drive system for rotation about the axis of rotation by the auger drive system;

a primary auger section including a primary auger sleeve, the primary auger sleeve being disposed about the primary auger shaft;

a primary auger clutch, the primary auger clutch being actuable between a primary auger clutch engaged position and a primary auger clutch disengaged position, wherein the primary auger section is coupled for rotation with the primary auger shaft when the primary auger clutch is disposed in the primary auger clutch engaged position, and the primary auger section is not coupled for rotation with the primary auger shaft when the primary auger clutch is disposed in the primary auger clutch disengaged position;

at least a first auger extension selectively rotatable about the axis of rotation; and at least a first auger extension clutch, the first auger extension clutch being actuable between a first auger extension clutch engaged position and a first auger extension clutch disengaged position, wherein the first auger extension is coupled for rotation with the primary auger shaft when the first auger extension clutch is disposed in the first auger extension clutch engaged position, and the first auger extension is not coupled for rotation with the primary auger shaft when the first auger extension clutch is disposed in the first auger extension clutch disengaged position;

wherein the first auger extension includes at least one of the following:

the first auger extension being secured with a first auger extension shaft, wherein actuation of the first auger extension clutch between the first auger extension clutch engaged position and the first auger extension clutch disengaged position engages or disengages the first auger extension shaft from rotation with the primary auger shaft, and the first auger extension including a first auger extension sleeve, the first auger extension sleeve being disposed for selective rotation about a first auger extension shaft, the first auger extension shaft being secured for rotation with the primary auger shaft, wherein the first auger extension sleeve is coupled for rotation with the first auger extension shaft when the first auger extension clutch is disposed in the first auger extension clutch engaged position, and the first auger extension sleeve is not coupled for rotation with the first auger extension shaft when the first auger extension clutch is disposed in the first auger extension clutch disengaged position.

19. The auger assembly of claim 18 further including at least a second auger extension selectively rotatable about the axis of rotation with the primary auger shaft.

20. The auger assembly of claim 19 further including:

at least a second auger extension clutch, the second auger extension clutch being actuable between a second auger extension clutch engaged position and a second auger extension clutch disengaged position, wherein the second auger extension is coupled for rotation with the first auger extension shaft when the second auger extension clutch is disposed in the second auger extension clutch engaged position, and the second auger extension is not coupled for rotation with the first auger extension shaft when the second auger extension clutch is disposed in the second auger extension clutch disengaged position;

wherein the second auger extension includes at least one of the following:

the second auger extension being secured with a second auger extension shaft, wherein actuation of the second auger extension clutch between the second auger extension clutch engaged position and the second auger extension clutch disengaged position engages or disengages the second auger extension shaft from rotation with the first auger extension shaft, and the second auger extension including a second auger extension sleeve, the second auger extension sleeve being disposed for selective rotation about a second auger extension shaft, the second auger extension shaft being secured for rotation with the first auger extension shaft, wherein the second auger extension sleeve is coupled for rotation with the second auger extension shaft when the second auger extension clutch is disposed in the second auger extension clutch engaged position, and the second auger extension sleeve is not coupled for rotation with the second auger extension shaft when the second auger extension clutch is disposed in the second auger extension clutch disengaged position.

* * * * *